US007526243B2

(12) United States Patent
Zaman et al.

(10) Patent No.: US 7,526,243 B2
(45) Date of Patent: Apr. 28, 2009

(54) VIBRATION METHOD TO REDUCE AND/OR ELIMINATE FRICTION/NOISE

(75) Inventors: Kamran U. Zaman, Pittsford, NY (US); Stanley J. Pietrzykowski, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 104 days.

(21) Appl. No.: 11/879,172

(22) Filed: Jul. 16, 2007

(65) Prior Publication Data

US 2009/0022529 A1 Jan. 22, 2009

(51) Int. Cl.
*G03G 21/00* (2006.01)

(52) U.S. Cl. ..... 399/350; 399/351

(58) Field of Classification Search ..... 399/34, 399/71, 123, 350, 351
See application file for complete search history.

(56) References Cited

U.S. PATENT DOCUMENTS 4,111,545 A * 9/1978 Meltzer ..... 399/351
4,875,070 A * 10/1989 Hattori ..... 399/350
5,842,102 A * 11/1998 Montfort et al. ..... 399/349
6,044,245 A * 3/2000 Kabashima et al. ..... 399/350
6,128,461 A * 10/2000 Yoshikawa ..... 399/350
7,415,236 B2 * 8/2008 Nakano et al. ..... 399/350
2003/0021618 A1 * 1/2003 Ogara et al. ..... 399/350
2003/0031488 A1 * 2/2003 Kunishi et al. ..... 399/343

FOREIGN PATENT DOCUMENTS

JP 2003043893 A * 2/2003
JP 2003248401 A * 9/2003
JP 2004239946 A * 8/2004
JP 2005338170 A * 12/2005

* cited by examiner

*Primary Examiner*—Robert Beatty
(74) *Attorney, Agent, or Firm*—James J. Ralabate

(57) ABSTRACT

A small vibrator is connected to a cleaning blade or cleaning blade holder in an electrostatic marking system. This vibrator in a cycle out step moves the blade up and down and reduces thereby overall contact with the photoconductor surface; this reduces any noise caused by blade contact with the photoconductor surface during cycling out or down of the marking procedure.

16 Claims, 2 Drawing Sheets

VIBRATION METHOD TO REDUCE AND/OR ELIMINATE FRICTION/NOISE

The present embodiments relate to an electrophotographic marking system and, more specifically, to a cleaning blade assembly useful in said system.

BACKGROUND

In marking systems such as Xerography or other electrostatographic processes, a uniform electrostatic charge is placed upon a photoreceptor surface. The charged surface is then exposed to a light image of an original to selectively dissipate the charge to form a latent electrostatic image of the original. The latent image is developed by depositing finely divided and charged particles of toner upon the photoreceptor surface. The toner may be in dry powder form or suspended in a liquid carrier. The charged toner, being electrostatically attached to the latent electrostatic image areas, creates a visible replica of the original. The developed image is then usually transferred from the photoreceptor surface to a final support material such as paper and the toner image is fixed thereto to form a permanent record corresponding to the original.

In these electrostatic marking systems, a photoreceptor surface is generally arranged to move in an endless path through the various processing stations of the Xerographic process. Sometimes, the photoreceptor or photoconductor surface is in the form of an endless belt and in other systems it's in the form of a drum. Since the photoreceptor surface is reusable when the toner image is transferred to a final support material such as paper, the surface of the photoreceptor is cleaned by a blade and/or brushes and prepared to be used once again in the copying process. In this endless path, several Xerographic related stations are traversed by the photoconductive belt or drum.

In one embodiment after the transfer station, a photoconductor cleaning station is sequentially next. This cleaning station may comprise a cleaning brush and/or a cleaning or doctor blade which is used to remove residual debris from the belt or drum photoconductive surface. A film or debris on the photoconductor surface is generally caused by the toner being impacted onto the belt by the cleaning brushes or other components in the marking system.

When a blade cleaner is used to clean a photoreceptor surface, once the machine cycles out or slows down, the blade may stick and slip on this surface through difference frequencies, causing an audible noise known as grunting. At the end of the printing or copying job, interaction between the photoreceptor surface and the blade normally takes place. As noted, it is this stick and slip blade motion which produces this annoying grunt noise. This noise ultimately results often in unscheduled service calls and reduces customer satisfaction and sometimes productivity.

There are known various noise masking systems used in image-forming apparatus such as those in Fuji Xerox U.S. Pat. No. 5,784,670 (Sasahara I) and U.S. Pat. No. 5,930,557 (Sasahara II). However, none of these known systems deals with the noise problems caused by the interaction of a cleaning blade with a photoreceptor surface. In Sasahara I, his invention deals with a noise masking system in an image forming apparatus such as a laser beam printer or a copying machine having a drive mechanism acting as a noise generation source during operation. The noise masking system comprising a masking sound generator for generating a sound to mask the noise and masking sound control means which controls the masking sound generator to generate a masking sound of a frequency range including a main component frequency of the noise. The masking sound thus generated is of a frequency range from a lower limit frequency to an upper limit frequency in a critical band of the main component frequency of the noise. The noise masking system masks noise to eliminate a psychological unpleasant feeling caused by frequency fluctuation.

In Sasahara II, his invention deals with a noise masking system in an image forming apparatus such as a laser beam printer or a copying machine having a drive mechanism acting as a noise generation source during operation. The noise masking system comprising a masking sound generator for generating a sound to mask the noise and masking sound control device which controls the masking sound generator to generate a masking sound of a frequency range including a main component frequency of the noise. The masking sound thus generated is of a frequency range from a lower limit frequency to an upper limit frequency in a critical band of the main component frequency of the noise. Both Sasahara patents deal with masking a noise rather than eliminating or reducing the noise.

SUMMARY

In Xerographic printers and copiers, at the end of the job, a close interaction between the organic photoconductor (OPC) or other photoconductor drums and cleaner blade takes place. This is similar to the stick and slip motion above mentioned which produces an annoying "grunt" noise. It is proposed in the present embodiments to use a tiny vibrator in connection with the cleaning blade or blade holder that actuates during cycle out and vibrates the blade. This vibration reduces the blade contact with photoconductive surface and hence reduces the friction caused thereby.

As noted, the embodiments of this invention provide the use of a tiny cell-phone size like vibrator that eliminates or mitigates the annoying audible noise known as "grunting" made in printers when a blade cleaner is used with OPC drum photoreceptor. The grunt sound is annoying to customers and causes concerns over possible defects in the marking system. This grunt is always heard as the machine cycles out and is attributed to a resonant reached as the blade sticks and slips through different frequencies as the marking machine slows down. The tiny vibrator would only be turned out during cycle out, is very low cost and would move the blade up and down thereby reducing friction and eliminating or minimizing the annoying grunt sound. Any suitable vibrator may be used. A small vibrator is preferred since it can easily be retrofitted into existing blade assemblies, or fit into the originally manufactured configuration. A typical suitable vibrator is Tiny Vibrator Motor Made Motorola Products—This tiny vibrator motor body is only 0.44" L×0.18" Dia. It has a weight attached to its shaft. In a different use, these vibrators make great motion generators to cause movement in tiny robots, and are also useful in making silent alert alarms, timers, etc. It has 2 flexible terminals for power connection, and will operate from 1VDC up to 9VDC. This vibrator motor has a black rubberized boot that can be removed if necessary to reduce its size even further. It is one of the smallest and best quality vibrator motors and well suited for use in embodiments this invention since it can be used within a limited space in the marking machine.

DETAILED DISCUSSION OF DRAWINGS AND PREFERRED EMBODIMENTS

Figure 1:
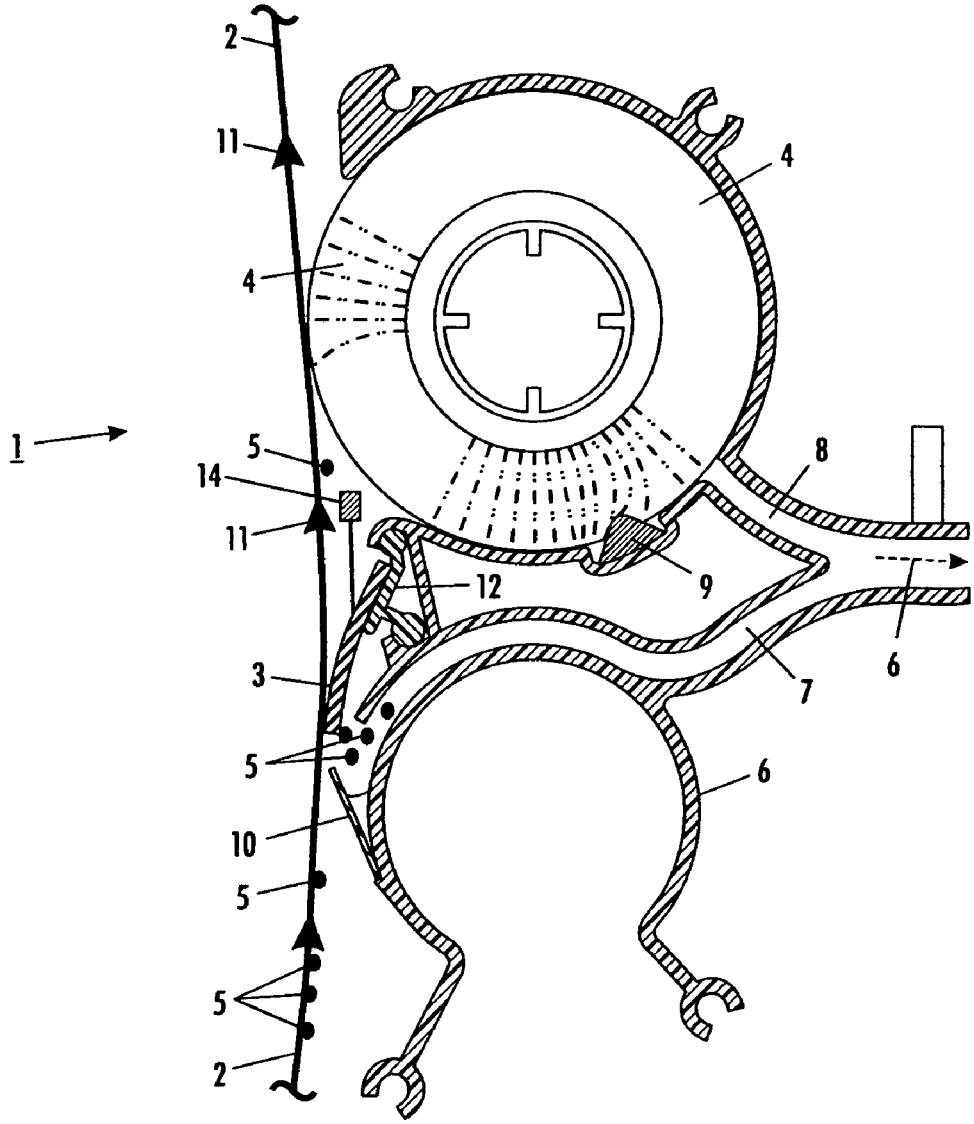
FIG. 1 is a plan side view of a cleaning station in an embodiment of this invention.
Figure 2:
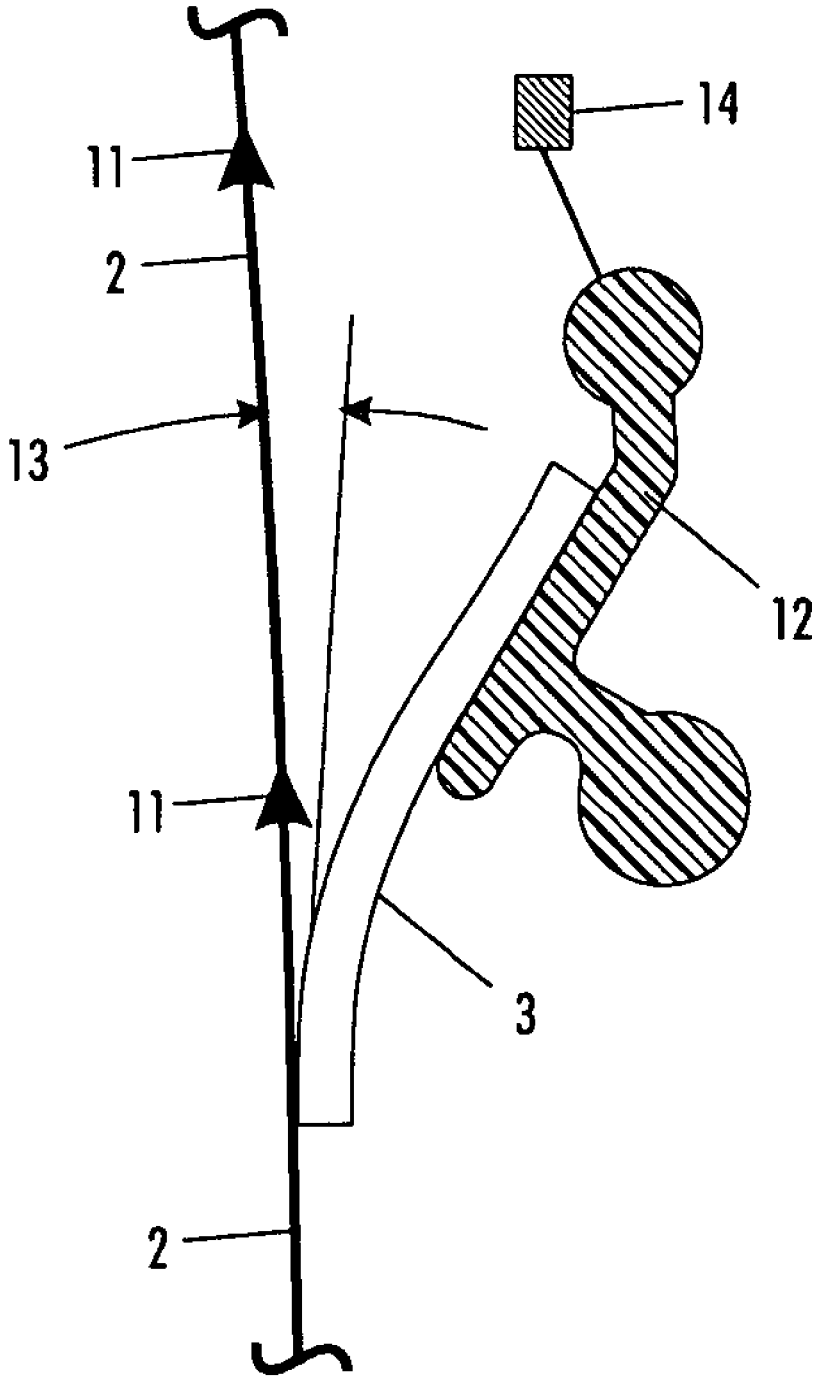
FIG. 2 is a plan side view of a cleaning blade with a blade holder and vibrator as in an embodiment of this invention.

In FIG. 1, as a background to functioning of a cleaning station of an electrostatic marking system the following occurs. In cleaning system 1 of an embodiment, a photoconductive (PC) belt 2 is shown as it is adapted to move sequentially first to the cleaning blade 3 and then to an electrostatic brush 4. While a cleaning brush 4 is used in this embodiment, it should be understood that it is not always necessary to have or use a cleaner brush 4. For some marking machines, just a cleaner blade 3 and gravity to collect falling toner works well. Thus, in a cleaning station comprising a cleaner blade 3, a vibrator 14 and a blade holder 12 is required for this invention. Reference to "blades" as used in this disclosure and claims will include both cleaning blades and spots blades. The arrows 11 show the direction and path of the PC belt 2. The blade 3 in one embodiment is upstream from the brush 4 and is the first cleaning component that contacts the belt. In this position, blade 3 gets the proper toner induced lubrication since toner has not been previously removed by a brush 4 or any other component. The electrostatic brush 4 has a charge on it that is opposite to the charge on the toner 5 used in the system. This will permit brush 4 to attract the opposite charged toner 5 and remove any residual toner 5 not removed from the PC belt 2 by the cleaning blade 3. As above stated, since the cleaning blade 3 in one embodiment is the first cleaning component contacted by the belt 2, there is sufficient toner 5 on the belt at that point to provide ample lubrication for the blade 3 and minimize abrasion of the belt 2. However, this lubrication does not help to reduce any noise or grunt caused by blade 3 contacting the PC 2 during cycling out. By "cycling out" or "cycling down" is meant the time when the marking job is completed and the marking apparatus is shutting down or is turning off. In a typical cleaning system, a vacuum unit 6 is positioned between the blade 3 and brush 4 to vacuum off any loose toner 5 removed by either blade 3 and brush 4. After the toner is vacuumed out it can be disposed of by any suitable method. Vacuum air channels 7 and 8 are in air flow contact with the blade 3 and brush 4, respectively. Blade 3 is composed of a flexible material such as rubber, elastomers or other suitable pliable material. A flicker bar 9 is in operative contact with brush 4 and is adapted to de-tone brush 4 together with vacuum unit 6. As toner 5 is flicked off brush 4 by flicker bar 9, it is picked up by the suction of vacuum channel 8 and transported out of system 1. An entry shield 10 is located below the cleaning blade 3 and directs loosened toner into vacuum channel 7 for removal from system 1. Toner 5, therefore, is sequentially removed from photoconductor belt 2 by first contact with blade 3 which scrapes toner 5 off belt 2 and then by cleaner brush 4 which removes any residual toner by brush action together with electrostatic action (since it is biased oppositely to toner). By this continuous contact with the photoconductive belt 2, the blade 3 in the prior art at cycle out time causes the above-noted audible noise known as grunting. This annoying audible noise of grunting is eliminated or mitigated by the use of a tiny vibrator 14 that is in electrical connection with either the blade 3 or blade holder 12. In FIG. 1, vibrator 14 is shown connected to blade 3. In FIG. 2, the vibrator 14 is shown connected to the blade holder 12. The vibrator 14 in one embodiment senses when the cycle event step is taking place and the vibrator 14 is activated to vibrate blade 3. As above noted, the vibration that occurs reduces the contact and force on the photoconductor PC surface 2 by the blade 3 and minimizes a stick and slip occurrence that is present in prior art cycle downs; this stick and slip of the blade 3 is what causes the loud grunting noise. While the vibrator 14 senses the cycle down event to be activated, any other suitable vibrator activation means may be used such as an audio sensor in the environment. A small vibrator 14 is used because it can be easily fit into the cleaning system either at original design or retrofitted. However, any suitable vibrator 14 may be used depending upon the nature of the cleaning subsystem, resonance frequency present or any other conditions. The grunting is believed to occur because the PC 2 is trying to move while the blade 3 is trying to stop. By vibrating or pulsing the blade 3, a substantial reduction in blade-PC contact occurs thereby reducing the PC-blade contact and force which causes this grunting noise.

While this grunting noise is most noticeable in electrostatic marking machines having speeds below 75 copies per minute (CPM) and the present embodiments are especially useful in these machines, the vibrator 14 may be used to reduce cycle down noise if it occurs in any marking machines having speeds of over 75 copies per minute. Field data showed that low speed marking machines produced louder grunts. Marking electrostatic machines were observed with speeds of 32 CPM, 38 CPM, 45 CPM and 55 CPM; all had this grunting sound at cycle down time. In our applications, the grunt sound was generally in the 270-275 Hz (hertz) area. Hertz is a unit of frequency equal to one cycle per second. The vibrator 14 reduces this noise significantly as indicated by human hearing.

In FIG. 2, the PC surface 2 is shown traveling in the direction of arrows 11 and in contact with flexible cleaning blade 3. Blade 3 is supported by a blade holder 12 which holds blade 3 in a cleaning position. In this embodiment, vibrator 14 is attached to blade holder 12 and thereby causes blade 3 to vibrate as holder 12 also vibrates. By lifting or pulsing blade 3 by the use of vibrator 14, blade-PC contact is reduced significantly thereby reducing the grunting caused by constant blade-PC contact at cycle down. Any suitable angle of contact 13 between the PC 2 and blade 3 may be used, an angle of from about 5-35° has been found to be effective for cleaning.

To summarize, embodiments of this invention provide an electrostatic marking system or machine, comprising in an operative arrangement, a vibrator, a photoconductor (PC) surface and a PC surface cleaning blade with a blade holder. This cleaning blade or blade holder has this vibrator operatively connected thereto. The vibrator is enabled to vibrate the blade and is enabled to reduce the overall contact of the blade to the photoconductor surface during a cycle down step and thereby reduce any noise resulting therefrom. The vibrator is enabled to move the cleaning blade and reduces the blade from sticking to the photoconductor surface. The vibrator is also enabled to reduce friction between the blade and the photoconductor surface.

The vibrator is enabled to be activated at least during a cycle out period and is enabled to interact with the blade and the photoconductor surface at least at the end portion of a printing or copying job. The vibrator is automatically activated by an audio sensor or as the machine is in the process of cycling out as the blade sticks and slips through different frequencies and as the machine slows down in the cycling out step. The vibrator is enabled to pulsate and move the blade up and down from contact with the photoconductor surface. The vibrator is operatively connected to the blade or connected to the blade holder.

To further briefly summarize the present embodiments, the marking machine in an embodiment has a speed up to about 75 copies per minute but the present embodiments can be used with any speed marking machine. In the present embodiment, it is provided that in an electrostatic marking system or machine is found in an operative arrangement, a photoconductive (PC) surface, a cleaning blade, a cleaning blade holder and a vibrator. This cleaning blade is adapted to clean the photoconductive (PC) surface during a marking operation. The vibrator is in operative contact with either or both the cleaning blade and the cleaning blade holder. The vibrator is enabled to reduce a grunt noise caused by blade-PC contact during a cycle out operation. The vibrator is activated by a member selected from the group consisting of a mechanical activator, an audio sensor, a timer or mixtures thereof. The vibrator is enabled to reduce the grunt noise at least 60% from a non-vibrator electrostatic marking apparatus cleaning system. Thus, the present embodiments provide a cleaning blade assembly for use in an electrostatic marking system comprising in an operative arrangement a cleaning blade, a cleaning blade holder and a vibrator. The vibrator is enabled to vibrate the blade and reduce its contact with a PC surface during cycle down operation and thereby reduce any noise resulting therefrom.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrostatic marking system or machine comprising:

a photoconductor (PC) surface and a PC surface cleaning blade with a blade holder, said cleaning blade or said blade holder having a vibrator operatively connected thereto, said vibrator enabled to vibrate said blade and enabled to reduce the overall contact of said blade to said photoconductor surface during a cycle down and thereby reduce any noise resulting therefrom, wherein said vibrator is automatically activated as the machine is in the process of cycling out and as the blade sticks and slips through different frequencies as the machine slows down in the cycling out step.

2. The system of claim 1 wherein said vibrator is enabled to move said cleaning blade and reduces said blade from sticking to said photoconductor surface.

3. The system of claim 1 wherein said vibrator is enabled to reduce friction between said blade and said photoconductor surface.

4. The system of claim 1 wherein said vibrator is enabled to be activated at least during a cycle out period.

5. The system of claim 1 wherein said vibrator is enabled to interact with said blade and said photoconductor surface at least at the end portion of a printing or copying job.

6. The system of claim 1 whereby said vibrator is enabled to pulsate and move said blade up and down from contact with said photoconductor surface.

7. The system of claim 1 whereby said vibrator is connected to said blade.

8. The system of claim 1 whereby said vibrator is connected to said blade holder.

9. The system of claim 1 whereby said marking machine has a speed up to about 75 copies per minute.

10. An electrostatic marking system or machine which comprises:

a photoconductive (PC) surface, a cleaning blade, a cleaning blade holder and a vibrator, said cleaning blade adapted to clean said photoconductive surface during a marking operation, said vibrator in operative contact with either or both said cleaning blade and said cleaning blade holder, said vibrator enabled to reduce a grunt noise caused by blade-PC contact during a cycle out operation, said vibrator activated by a member selected from the group consisting of a mechanical activator, an audio sensor, a timer or mixtures thereof, said vibrator enabled to reduce said grunt noise substantially from a non-vibrator cleaning system as indicated by human hearing, and wherein said vibrator is automatically activated as the machine is in the process of cycling out and as the blade sticks and slips through different frequencies as the machine slows down in the cycling out step.

11. The system of claim 10 wherein said vibrator is enabled to move said cleaning blade and reduces said blade from sticking to said photoconductor surface.

12. The system of claim 10 wherein said vibrator is enabled to reduce friction between said blade and said photoconductor surface.

13. The system of claim 10 wherein said vibrator is enabled to be activated at least during a cycle out period.

14. The system of claim 10 wherein said vibrator is enabled to interact with said blade and said photoconductor surface at least at the end portion of a printing or copying job.

15. The system of claim 10 whereby said vibrator is enabled to pulsate and move said blade up and down from contact with said photoconductor surface.

16. A cleaning blade assembly for use in the electrostatic marking system of claim 10 comprising in an operative arrangement a cleaning blade, a cleaning blade holder and a vibrator, said vibrator enabled to vibrate said blade and reduce its contact with a PC surface during cycle down operation.

* * * * *